US007525397B2

(12) United States Patent
Schmidt

(10) Patent No.: US 7,525,397 B2
(45) Date of Patent: Apr. 28, 2009

(54) STRIPLINE DIRECTIONAL COUPLER HAVING A WIDE COUPLING GAP

(75) Inventor: Ewald Schmidt, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 186 days.

(21) Appl. No.: 10/584,971

(22) PCT Filed: Dec. 9, 2004

(86) PCT No.: PCT/EP2004/053377

§ 371 (c)(1),
(2), (4) Date: May 25, 2007

(87) PCT Pub. No.: WO2005/064740

PCT Pub. Date: Jul. 14, 2005

(65) Prior Publication Data

US 2007/0296517 A1 Dec. 27, 2007

(30) Foreign Application Priority Data

Dec. 30, 2003 (DE) ..... 103 61 834
May 3, 2004 (DE) ..... 10 2004 021 535

(51) Int. Cl.
*H01P 5/18* (2006.01)
*H01P 3/08* (2006.01)

(52) U.S. Cl. ..... 333/116; 333/238

(58) Field of Classification Search ..... 333/109, 333/110, 111, 112, 113, 114, 115, 116, 238
See application file for complete search history.

(56) References Cited

U.S. PATENT DOCUMENTS 5,446,425 A 8/1995 Banba et al.
6,759,923 B1 * 7/2004 Scott et al. ..... 333/116
2003/0020568 A1 1/2003 Mizuntani et al.

FOREIGN PATENT DOCUMENTS

| | | |
|---|---|---|
| DE | 21 51 478 | 5/1973 |
| EP | 0 996 189 | 4/2000 |
| GB | 2 218 853 | 11/1989 |
| JP | 2238716 | 9/1990 |
| JP | 3295302 | 12/1991 |
| JP | 5067904 | 3/1993 |
| JP | 9116312 | 5/1997 |
| WO | WO 03/071628 | 8/2003 |

OTHER PUBLICATIONS

Professor D.U. Gysel, "HF-Passive Komponenten" ["Passive HF Components"], ZHW, Department of Technology, Information Technology and Natural Sciences, Electrical Engineering and Signal Processing, High-Frequency Engineering, Zurich, Dec. 5, 2003.

* cited by examiner

*Primary Examiner*—Dean O Takaoka
(74) *Attorney, Agent, or Firm*—Kenyon & Kenyon LLP

(57) ABSTRACT

The provided stripline directional coupler, having two coupling conductors galvanically isolated with respect to a grounding layer at zero potential, includes, in particular, a multilayer conductor pattern having at least three metallic layers separated by at least two dielectric insulating layers; a first metallic layer forming the coupling conductor, and a second of the at least three metallic layers having a conductor pattern, which is galvanically isolated from the at least two other metallic layers, and with the aid of which capacitors that are connected in series and are very small are formed between the at least three metallic layers.

10 Claims, 1 Drawing Sheet

STRIPLINE DIRECTIONAL COUPLER HAVING A WIDE COUPLING GAP

FIELD OF THE INVENTION

The present invention relates to a stripline directional coupler.

BACKGROUND INFORMATION

Directional couplers are circuit elements of high-frequency (HF) and aerial engineering and are used for asymmetrically dividing up power, e.g. at a magnitude of −12 dB, in a desired frequency range. Directional couplers always have a short wire segment, whose characteristic impedance corresponds to that of the utilized electric line. In this manner, a specific voltage is only decoupled from the forward wave or return wave.

A directional coupler relevant in this case is found in an article published on Dec. 5, 2003, having the title "HF-Passive Komponenten" ["Passive HF Components"], by Professor D. U. Gysel, ZHW, Department of Technology, Information Technology and Natural Sciences, Electrical Engineering and Signal Processing, High-Frequency Engineering, Zurich, and is schematically represented in FIG. 1, which is described below in detail.

As can be gathered from FIG. 1, directional couplers are designed to have four ports and have two receiving ports (input ports) and two transmitting ports (output ports). The two receiving ports must be decoupled from one another as much as possible. The stripline directional couplers in question here are produced, using conventional printed circuit technique. In this context, substrates having relatively low dielectric constants, as well as coupling gaps between the two conductors, having a very small gap width in the range of approximately 100 μm, are used in order to attain the desired, high coupling values of over 15 dB, for example, 12 dB. Thus, for a 12 dB coupler at 2.5 GHz on a conductor substrate having a thickness of 300 μm and a relative dielectric constant of 4.4, one only obtains a coupling gap width of approximately 80 μm, necessary for the above-mentioned coupling strength. Using today's printed circuit technology, such a small conductor gap can only be produced at a very high cost and degree of difficulty, and a simultaneously high reject rate.

Therefore, there is considerable need for being able to suitably produce directional couplers of the type in question here, using conventional printed circuit technology, which have minimal conductor widths and lateral conductor gaps in the range of 150 μm, as well as etching tolerances of up to +/−20 μm.

SUMMARY OF THE INVENTION

The directional coupler of the present invention is characterized, in particular, by a multilayer construction, in which at least three metallic layers, and between them at least two dielectric insulating layers, are arranged on a substrate, preferably on a printed circuit board. In this context, the directional coupler layout in itself may correspond to the layouts known in the related art.

In contrast to the related art, the grounding layer does not correspond to a metallic layer positioned directly beneath the conductor pattern of the directional coupler, but only a metallic layer following on top of it. An insulated and specially formed conductor pattern is produced, and preferably etched in, between the conductor pattern and the grounding layer, on a metallic layer positioned between them. Due to this pattern, very small capacitors connected in series are formed which allow the necessary coupling and, simultaneously, a high degree of electrical insulation between the mentioned metallic layers. This pattern allows a coupling gap to be produced, which is larger, by a factor of 5, than in the case of the patterns known in the related art.

In one preferred refinement, the known, insulated, and specially formed conductor pattern has the shape of an "H" lying crosswise. In principle, however, any other shape is conceivable, an example of the simplest shape being a rectangle that lies crosswise as well.

In a further refinement, additional patterns or pattern extensions are provided, preferably short, trapezoid-like patterns.

In another refinement, the reflective characteristics of the coupling conductor are improved, using small, capacitive structures (capacitor patches) positioned in the corners of the terminals. Consequently, the impedance of the coupling conductors, which is, as a whole, slightly inductive, is compensated for in such a manner, that particularly effective impedance matching is rendered possible at the terminals.

The directional coupler provided by the present invention may be produced, using conventional printed circuit technique, without any manufacturing restrictions, and also with customary etching tolerances. The directional coupler has, in particular, a very large coupling value, which, in the related art, would only be producible at a high cost and with a high degree of difficulty. In addition, due to the present invention, the manufacturing deviation of the directional-coupler parameters, such as, in particular, the HF-specific parameters, becomes considerably smaller. In addition, the use of less expensive substrates and less expensive etching processes is rendered possible in the production of the patterns forming the basis of the directional coupler.

DETAILED DESCRIPTION

Figure 1:
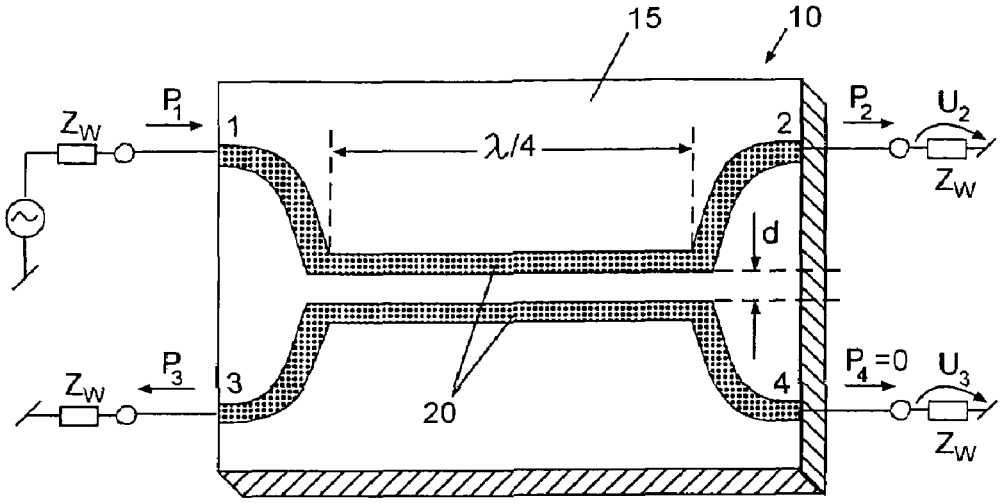
Fig.1 (Prior Art)
FIG. 1 shows a basic representation of a stripline directional coupler according to the related art.

Directional coupler 10 schematically shown in an angular top view in FIG. 1 represents a stripline parallel-line coupler, that is, the electrical conductors take the form of thin metallic strips on a substrate 15. Substrate 15 is presently made up of an ordinary printed circuit board. The actual coupler is made up of two coupling conductors 20, which run parallel over a length of $\lambda/4$. Since the coupling between the two coupling conductors 20 naturally increases with decreasing (lateral) distance between the two conductors, distance d should be as small as possible to achieve sufficient coupling.

Such a directional coupler 10 represents a passive four-port, which has the characteristic that an input signal at one of the four ports 1-4 is always only transmitted to two of the three remaining ports. Namely, if the directional coupler shown in FIG. 1 is supplied with an incident wave at port 1, then waves emerge at ports 2 and 4, but ideally not at port 3. That is, port 3 is decoupled from port 1. If one monitors the division of all possible incident waves, the result is that port pairs 1 and 3, and 2 and 4, are decoupled from each other, i.e. no energy exchange takes place between them if all ports are terminated by their respective wave impedances. It should be noted that when the directional coupler is assumed to be ideal, ports 1 and 4, as well as 2 and 3, are decoupled in each case, i.e. no crosstalk takes place between them.

Since the currents generated by capacitive and by inductive coupling are simultaneously present in the measuring branch, i.e. in the above-mentioned electrical-line segment $\lambda/4$ of the two coupling conductors, they can either add or cancel each other out as a function of their phase angle and as a function of the direction of the current in the one conductor, which ultimately produces the above-mentioned directional coupling.

Figure 2:
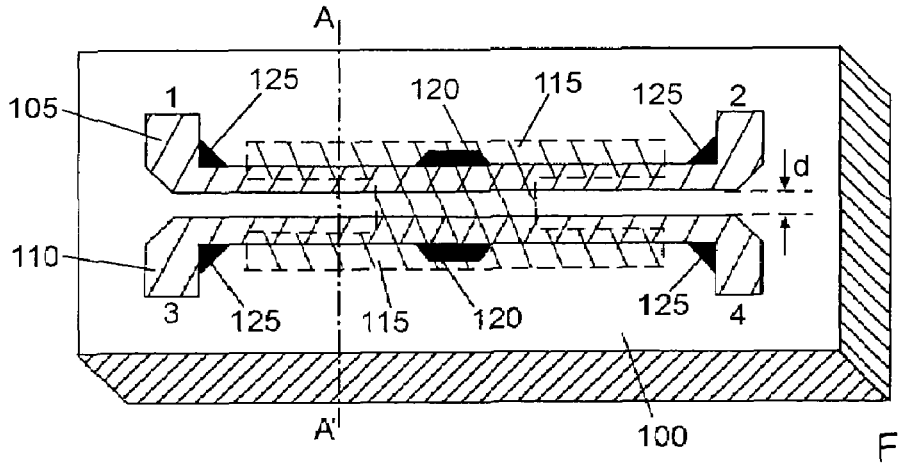
FIG. 2 shows a top view of a preferred embodiment of the stripline directional coupler according to the present invention.

The preferred embodiment of the multilayer directional coupler of the present invention, of which a top view is shown in FIG. 2, is made up of a printed circuit board 100 that has a plurality of metallic layers. These metallic layers include a top metallic layer in the form of copper strips ("TOP-Cu") 105, 110, by which the two coupling conductors 105, 110 necessary for the directional coupler are formed. The lateral distance between coupling conductors 105, 110 is again denoted by "d". A middle metallic layer ("Mid-1-Cu") 115, which is made up of copper strips as well and has, in the present exemplary embodiment, the shape of an "H" lying crosswise, is situated underneath top metallic layer 105, 110 and is galvanically isolated from it by an insulating layer not shown here (see FIG. 3). For improved differentiation, the two copper layers 105-115 are marked by different stripes. A copper grounding layer ("Mid-2-Cu") 220, which is not shown here (see FIG. 3), is galvanically isolated, in turn, from middle metallic layer 115 by an insulating layer not shown here, and is at zero potential, is situated underneath this middle metallic layer 115.

As already mentioned, the three metallic layers named are each galvanically isolated from each other by dielectric insulating layers not shown here, which are made of fiberglass/epoxy substrate material used in printed-circuit engineering. In the preferred embodiment, the metallic and insulating layers shown take the form of a conventional printed circuit board manufactured by an etching technique known per se.

Because of the above-mentioned "H" shape of middle metallic layer ("Mid-1-Cu") 115, all in all, several relatively small capacitors connected in series are produced between individual metallic layers 105-115, 220, the capacitors first allowing the required, strong coupling and simultaneously rendering possible a very high degree of dielectric isolation between the above-mentioned metallic layers. In particular, in the case of the same coupling power, this allows a coupling gap larger by a factor of 5 to be produced, using the above-mentioned, conventional printed-circuit etching technique.

In the present, specific embodiment, the coupling conductors shown in FIG. 2 have, along the coupling conductors, trapezoidal expansion surfaces 120, which are more or less centrally positioned and extend outwards, and due to which the coupling effect is intensified. In addition, capacitive structures ("capacitor patches") 125, with the aid of which the reflective characteristics of coupling conductors 105, 110 are improved, are situated in the corners of port terminals 1-4. In the case of these capacitive structures, the internal 90° angles are diagonally filled in by shown triangular shapes 125. However, other shapes generating a suitably small increase in area are also possible in principle, for instance a square shape, by which, though, a small, additional corner is then produced. All in all, the above-mentioned measures compensate for the, on the whole, slightly inductive impedance of the coupling conductors in such a manner, that highly effective impedance adjustment is rendered possible at the port terminals.

It should be noted that an additional specific embodiment of the directional coupler according to the present invention is produced by exchanging above-described, top 105, 110 and middle metallic layers 115. The described functioning method in itself is unaffected by this.

Figure 3:
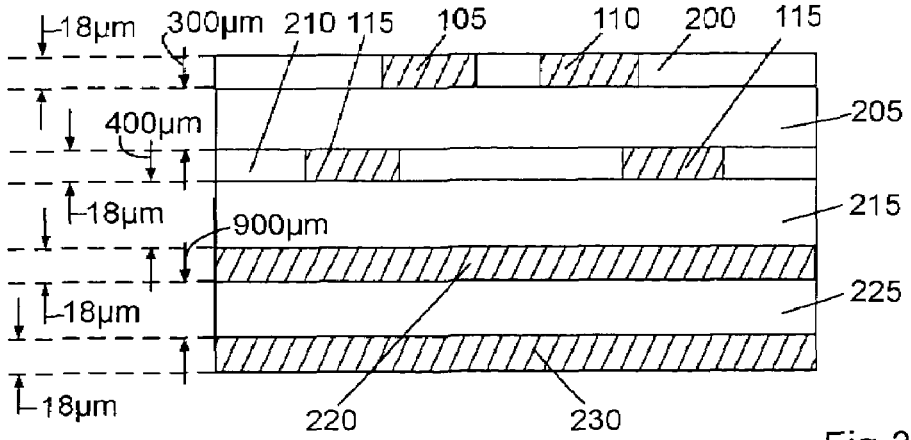
FIG. 3 shows a sectional view along line A-A of the directional coupler shown in FIG. 2.

The lateral sectional view shown in FIG. 3 corresponds to a section of the structure represented in FIG. 2, along line "A-A" drawn in there. The spatial arrangement of the three metallic layers 200, 210, 220 is shown even more clearly in FIG. 3. The respective layer thicknesses of metallic layers 200, 210, 220 are also deducible from it. Hatched regions 105, 110 correspond to the two coupling conductors in FIG. 2 denoted by identical reference numerals, and the two hatched regions 115 correspond to the "H"-shaped intermediate layer also shown in FIG. 2. Insulating layers 205, 215, 225 situated between metallic layers 200, 210, 220 are also drawn into FIG. 3. Top metallic layer 200 is chiefly used as a component side, i.e. for connecting the shown directional-coupler pattern to additional HF components in the field of aerial engineering, whereas an additional, fourth, bottom metallic layer 230 is used for connecting the shown directional-coupler pattern to an externally positioned antenna (not shown here).

Regarding the manufacturing of the printed circuit board pattern shown in FIG. 3, it should be noted that, based on the multilayer technique known per se, regions in which a conductor position is etched off are filled with dielectric material at an elevated temperature while being pressed together.

An 11 dB directional coupler actually manufactured in accordance with the above-described pattern has a nominal coupling-gap value of 380 μm. In this context, etching tolerances of up to +/−40 μm did not at all prevent the respective directional coupler from functioning perfectly. With this specification, conventional couplers would only have a coupling value of approximately 20 dB, or they would require a small coupling gap of 80 μm, which cannot be produced using printed-circuit technique.

The above-described directional-coupler pattern is preferably provided in the frequency range of up to several GHz, and for use on printed circuit boards. However, the above-described patterns may also be used, in principle, with all of the mentioned advantages, in special HF substrates, at higher frequencies, for example at the 77 GHz frequently used in automotive engineering. Equally feasible is the integrated use of the patterns in HF-IC's at even higher frequencies (122 GHz, 150 GHz).

What is claimed is:

1. A stripline directional coupler, comprising:

two coupling conductors that are galvanically isolated with respect to a grounding layer at zero potential and that each have a port terminal on their ends; and a multilayer conductor pattern having at least three metallic layers separated by at least two dielectric insulating layers, a first metallic layer forming the coupling conductor, and a second of the at least three metallic layers having a conductor pattern that is galvanically isolated from the at least two additional metallic layers, and with the aid of which small capacitors connected in series are formed between the at least three metallic layers.

2. The directional coupler as recited in claim 1, wherein the multilayer conductor pattern takes the form of a multilayer dielectric substrate.

3. The directional coupler as recited in claim 2, wherein the conductor pattern galvanically isolated from at least three metallic layers by the at least two insulating layers is spatially situated between the at least three metallic layers.

4. The directional coupler as recited in claim 3, wherein the grounding layer is isolated from the metallic layer of the coupling conductor by at least one additional metallic layer.

5. The directional coupler as recited in claim 1, wherein the conductor pattern galvanically isolated from the at least three metallic layers laterally has the shape of one of:

an "H" lying crosswise in the direction of the two coupling conductors, and a rectangle lying crosswise in the direction of the coupling conductors.

6. The directional coupler as recited in claim 1, further comprising:

additional conductor patterns corresponding to small trapezoid-like structures are situated on the coupling conductors.

7. The directional coupler as recited in claim 1, wherein capacitive structures for adjusting impedance are situated in the corners of the port terminals of the two coupling conductors.

8. The directional coupler as recited in claim 1, wherein internal 90° angles of the port terminals of the two coupling conductors designed to produce a small increase in area.

9. The directional coupler as recited in claim 8, wherein the increase in area of the port terminals of the two coupling conductors is formed by one of a transverse triangular shape and a square shape.

10. The directional coupler as recited in claim 1, wherein the at least three metallic layers are made out of copper, and the at least two insulating layers are made out of a fiberglass/epoxy combination.

* * * * *